United States Patent [19]

Biró et al.

[11] 3,939,443

[45] Feb. 17, 1976

[54] FREQUENCY-SELECTIVE COUPLING FOR HIGH-FREQUENCY ELECTROMAGNETIC WAVES

[75] Inventors: Oszkár Biró; Edit Dányi; Magdolna Fenyvesi; János Pamuk, all of Budapest, Hungary

[73] Assignee: Finommechanikai Vallalat, Budapest, Hungary

[22] Filed: May 29, 1974

[21] Appl. No.: 474,157

Related U.S. Application Data

[63] Continuation-in-part of Ser. No. 317,259, Dec. 21, 1972, abandoned.

[30] Foreign Application Priority Data

Jan. 7, 1972 Hungary ..... FI 506

[52] U.S. Cl. ..... 333/73 R; 333/24 C; 333/73 C; 333/82 B

[51] Int. Cl.[2] ..... H01P 1/20; H01P 7/04

[58] Field of Search ... 333/24 C, 73 R, 73 C, 73 W, 333/76, 82 B, 83 R

[56] References Cited

UNITED STATES PATENTS

| | | | |
|---|---|---|---|
| 2,844,801 | 7/1958 | Sabaroff | 333/73 C X |
| 2,931,992 | 4/1960 | Caroselli | 333/73 W X |
| 2,997,672 | 8/1961 | Reinsmith | 333/24 C |
| 3,538,463 | 11/1970 | Pakan | 333/73 R |
| 3,693,115 | 9/1972 | Edson | 333/73 R |
| 3,763,447 | 10/1973 | Takahashi et al. | 333/73 R |

*Primary Examiner*—Paul L. Guensler
*Attorney, Agent, or Firm*—Karl F. Ross; Herbert Dubno

[57] ABSTRACT

Two microwave circuits are interconnected through a plurality of juxtaposed but physically separated modular units each consisting of a substantially cylindrical grounded conductive shell and a central conductor extending axially within that shell, the latter being open at one or both ends. The central conductor, which may be straight or helically coiled, has a length equal to one or more quarter wavelengths, with points separated by odd numbers of quarter wavelengths alternately grounded to the shell and ungrounded. The central conductors of adjoining modular units confront each other through the open shell ends, the confronting extremities of each juxtaposed pair being either both grounded or both ungrounded for inductive or capacitive coupling. To tune the resulting microwave filter, the juxtaposed units can be relatively shifted or rotated.

5 Claims, 18 Drawing Figures

PRIOR ART

FREQUENCY-SELECTIVE COUPLING FOR HIGH-FREQUENCY ELECTROMAGNETIC WAVES

CROSS-REFERENCE TO THE RELATED APPLICATION

This application is a continuation-in-part of our copending application Ser. No. 317,259 filed Dec. 21, 1972 and now abandoned.

FIELD OF THE INVENTION

Our present invention relates to a frequency-selective coupling for high-frequency electromagnetic waves, designed to serve as a microwave filter inserted between an input and an output circuit.

BACKGROUND OF THE INVENTION

It is known to construct band-pass filters for high-frequency waves, in the UHF and VHF ranges (e.g. in the band of 50 to 1000 MHz), as cavity resonators with distributed reactances representing an antiresonant network at a predetermined operating frequency. Such a resonator generally consists of a grounded metallic shell, usually cylindrical, and a central conductor coaxial therewith. The central conductor, which may be linear or helically coiled, has an effective length of $\lambda/4$ where $\lambda$ is the wavelength at the predetermined operating frequency. One end of this conductor is grounded to the shell whereas the other, a quarter wavelength away, is ungrounded. The conductor thus constitutes an inductance terminating at a capacitance at its ungrounded end. It has also been proposed (see U.S. Pat. No. 3,538,463) to dispose two such conductors in a common shell, with their ungrounded ends confronting each other to form a capacitance flanked by two inductances.

OBJECTS OF THE INVENTION

The general object of our present invention is to provide a high-frequency coupling of this type which, when inserted between an input and an output circuit, can be conveniently tuned for selective filtering of the transmitted microwaves.

Another object is to provide a filter structure of this nature which can be built up from a plurality of basic modular units and can therefore be easily extended to permit selection of various response characteristics with flat or undulating (Tchebyscheff-type) attenuation peaks.

SUMMARY OF THE INVENTION

The foregoing objects are realized, in accordance with our present invention, by the provision of a plurality of juxtaposed but physically separated antiresonant units of the general character described above, i.e. with a substantially cylindrical grounded conductive shell and a generally axial conductor, the latter having at least one point grounded to the shell and at least one ungrounded point spaced therefrom by a quarter wavelength or, more generally, an odd number of quarter wavelengths. Corresponding points, either grounded or ungrounded, at confronting extremities of a pair of such central conductors approach close to each other through open ends of their respective shells whereby these conductors are reactively coupled with each other, either capacitively (if the extremities are ungrounded) or inductively (if they are grounded). Two or more such units may thus be cascaded in a group provided with input means coupled to the central conductor of one terminal unit and output means coupled to the central conductor of another terminal unit. The physical separation of the juxtaposed units enables variation of the reactive coupling between their confronting conductor extremities for tuning purposes.

Preferably, pursuant to a further feature of our invention, the tuning is accomplished by mounting the shells of juxtaposed units with freedom of relative displacement, either linear or angular. In a particular advantageous embodiment, the juxtaposed units are relatively rotatable about a common axis and their conductors are designed as coaxial helices, the ends of the helices being subject to a greater or lesser degree of disalignment upon such relative rotation. In principle, however the coupling could also be modified by the selective interposition of electrically conductive or magnetically permeable inserts between the confronting extremities to alter their capacitance or mutual inductance.

BRIEF DESCRIPTION OF THE DRAWING

The above and other features of our invention will now be described in detail with reference to the accompanying drawing in which.

SPECIFIC DESCRIPTION

Figure 1A:
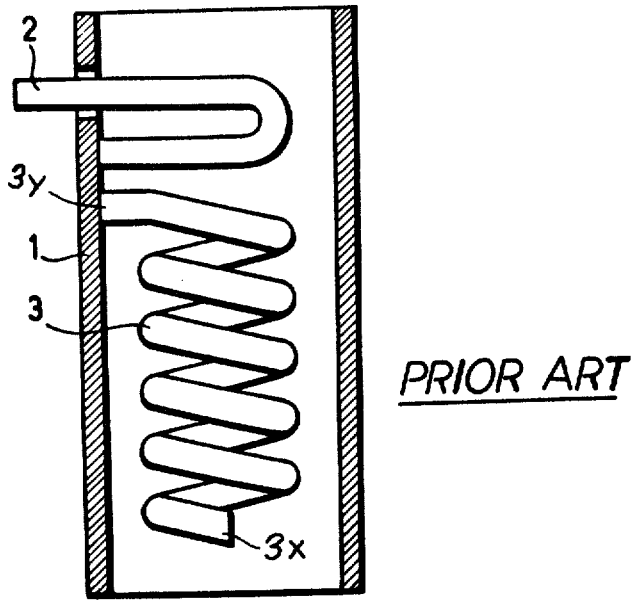
FIG. 1*a* is an axial sectional view of a conventional cavity resonator.
Figure 1B:
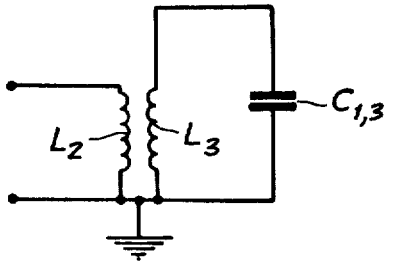
FIG. 1*b* is an equivalent circuit diagram for the resonator of FIG. 1*a;*

In FIG. 1*a* we have shown a conventional cavity resonator comprising a cylindrical shell 1, a coupling loop 2 and a helical central conductor 3, the latter having a free extremity 3*x* and a grounded extremity 3*y* connected to the shell 1. As indicated in the equivalent circuit diagram of FIG. 1*b*, loop 2 forms an inductance $L_2$ electromagnetically coupled with an inductance $L_3$ constituted by the helix 3. A capacitance $C_{1,3}$ is defined by the conductor 3 and the grounded shell 1. Inductance $L_3$ and capacitance $C_{1,3}$ constitute an antiresonant circuit tuned to a frequency of wavelength λ, the physical length of conductor 3 between extremities 3*x* and 3*y* being substantially equal to λ/4.

Figures 2A, 2B, 2C:
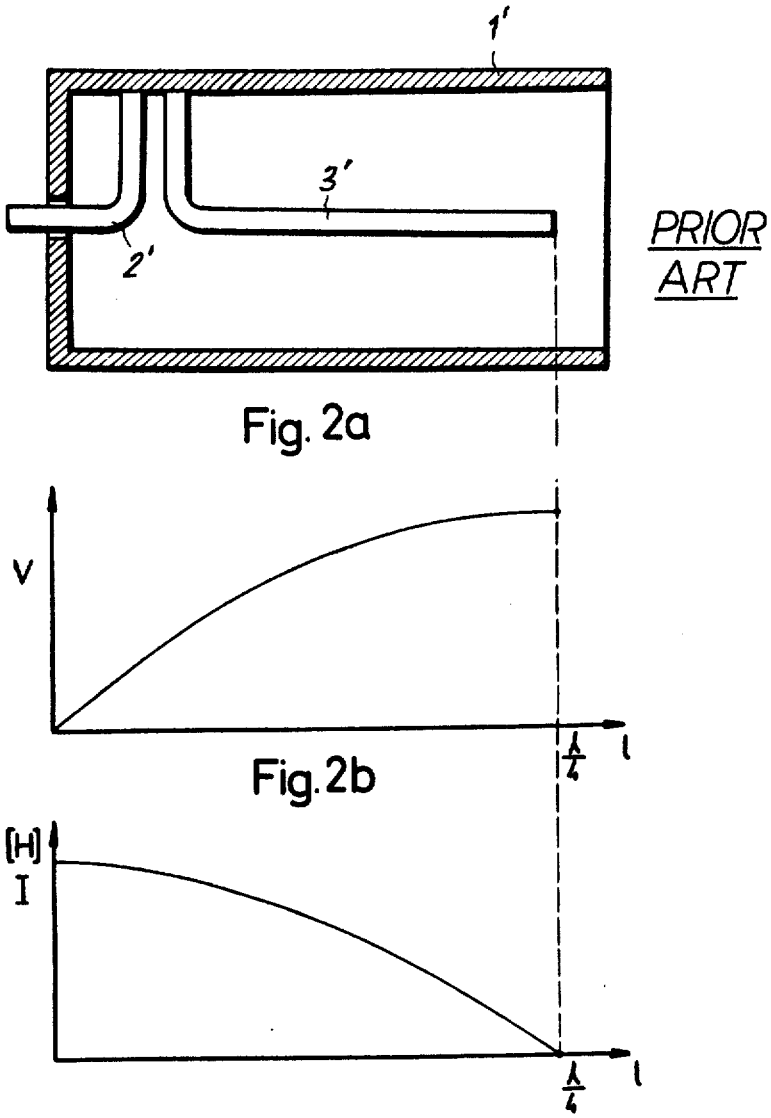
FIG. 2*a* shows a similar cavity resonator of known construction.
FIGS. 2*b* and 2*c* are voltage and current diagrams relating to the resonator of FIG. 2*a;*

In FIG. 2*a* we have shown a generally similar resonator whose shell 1' has a substantially closed end on the side of input or output coupling 2'; the conductor 3' is here shown as an elbow-shaped wire whose axially extending main portion is straight rather than coiled. FIG. 2*b* graphically indicates the distribution of voltage V, at resonance, over the length *l* of conductor 3'; FIG. 2*c* indicates the corresponding distribution of current I and of the accompanying magnetic field H. In both graphs the origin ($l = 0$) is located to the left of the grounded end of conductor 3' in FIG. 2*a*, in order to take into account the additional length of the radial conductor portion.

The voltage V, FIG. 2*b*, rises substantially along a sine curve from zero at the origin to its peak at λ/4. The current I, FIG. 2*c*, drops substantially along a cosine curve from a peak at the origin to zero at λ/4. A generally similar law of distribution applies to helical conductors of the type shown in FIG. 1*a*.

Figure 3A:
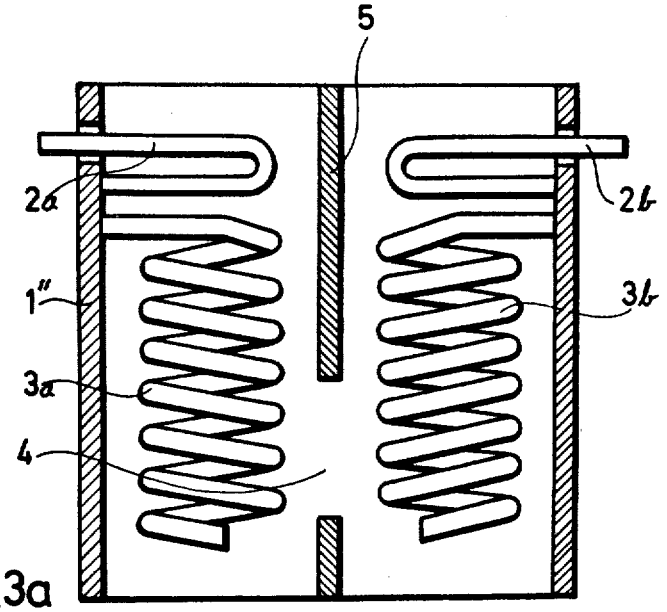
FIG. 3*a* shows a prior-art coupling between a pair of resonators of the type illustrated in FIG. 1*a;*
Figure 3B:
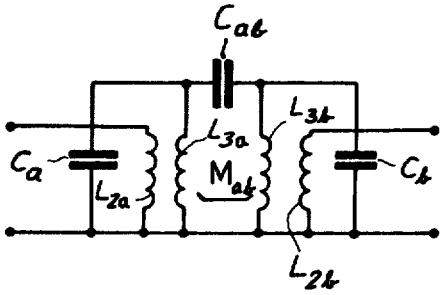
FIG. 3*b* shows the equivalent circuit for the system of FIG. 3*a;*

In FIG. 3*a* we have illustrated a conventional coupling between two helicoidal conductors 3*a* and 3*b* forming part of two resonators of the type shown in FIG. 1*a*, these resonators having a common shell 1'' divided into two compartments by a central partition 5. A gap 4 in that partition, near the free ends of the two coils 3*a* and 3*b*, reactively couples these coils to each other, thereby enabling the transmission of wave energy from an input loop 2*a* to an output loop 2*b* via a filter network whose equivalent circuit is shown in FIG. 3*b*. This network has four inductances $L_{2a}$, $L_{3a}$ and $L_{2b}$, $L_{3b}$, input and output capacitances $C_a$ and $C_b$ defined by the shell 1'' with conductors 3*a* and 3*b*, and a coupling capacitor $C_{ab}$ formed by these conductors across the gap 4; the reactive coupling between the conductors also has an inductive component $M_{ab}$ which increases, at the expense of the capacitive component $C_{ab}$, with progressive shifting of the gap 4 toward the grounded ends of the coils. Such a system, therefore, provides a mixed capacitive and inductive coupling which, moreover, cannot be readily adjusted to provide a desired attenuation characteristic.

Figure 4A:
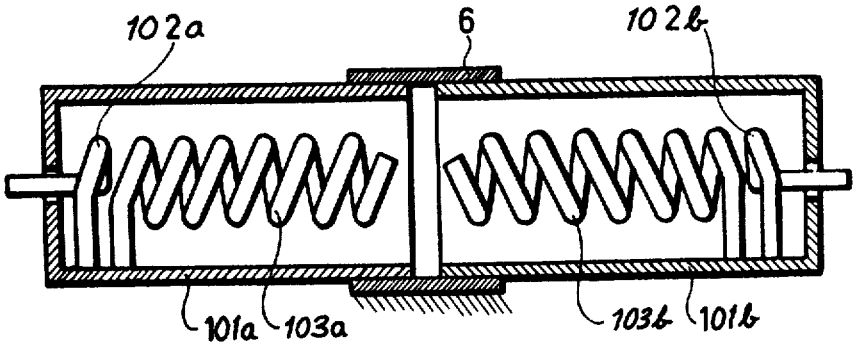
FIG. 4*a* is an axial sectional view of a two-unit microwave filter embodying our invention.
Figure 4B:
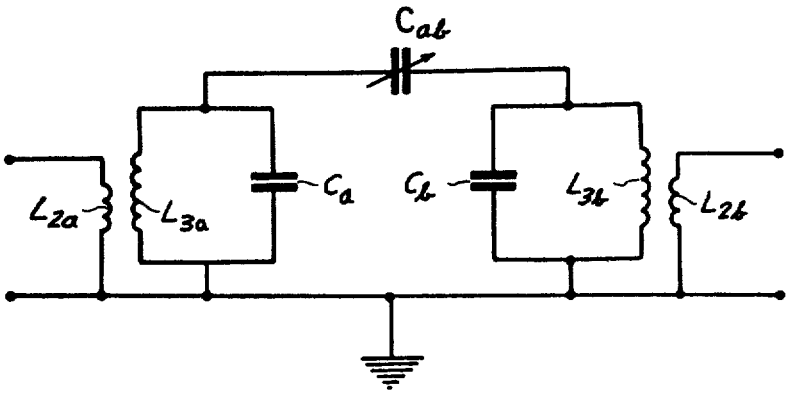
FIG. 4*b* shows the equivalent circuit for the filter of FIG. 4*a;*

In FIG. 4*a* we have shown a coupling according to our invention, effective as a band-pass filter, which comprises a pair of coaxially juxtaposed shells 101*a*, 101*b* with open ends facing each other, each of these shells containing a helical conductor 103*a*, 103*b* and an associated input or output loop 102*a*, 102*b* inductively coupled therewith. The free ends of the two helices 103*a*, 103*b*, separated by a quarter wavelength (or possibly by an odd multiple thereof) from the grounded opposite ends anchored to the shell structure, are capacitively coupled to each other. This has been symbolized in FIG. 4*b* by a capacitance $C_{ab}$ interlinking the two parallel-resonant networks defined by inductances $L_{3a}$, $C_a$ and $L_{3b}$, $C_b$ which are electromagnetically coupled to the respective input and output inductances $L_{2a}$, $L_{2b}$. The shells are mechanically interconnected by a sleeve mounting enabling their relative displacement, either axial or rotary, to vary the spacing of their free extremities and thereby to change the magnitude of the coupling capacitance $C_{ab}$. The selected coupling capacitance may be maintained by suitable fastening means, not shown, such as one or more setscrews on sleeve 6 engaging the movable shell or shells.

Figure 5A:
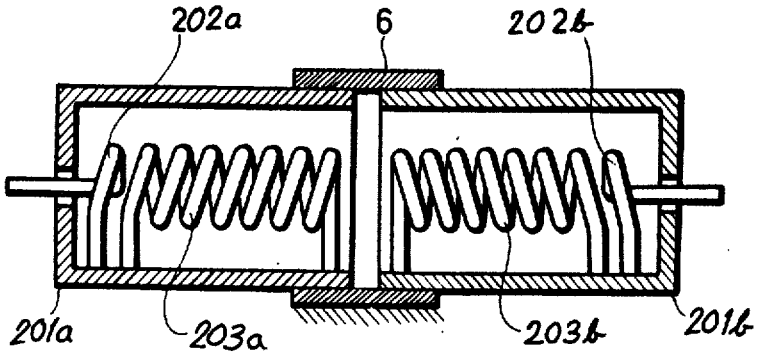
FIG. 5*a* is a view similar to FIG. 4*a*, illustrating a modification.
Figure 5B:
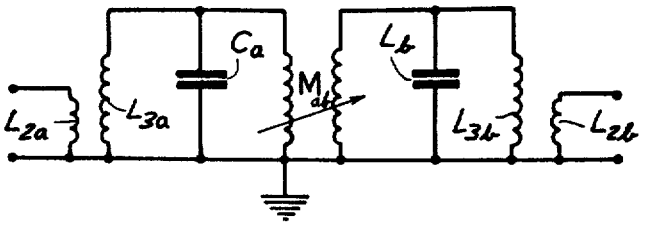
FIG. 5*b* is the equivalent circuit diagram for the structure of FIG. 5*a;*

In an analogous manner, FIGS. 5*a* and 5*b* show the physical structure and the equivalent circuit of a coupling comprising shells 201*a*, 201*b* with input and output loops 202*a*, 202*b* and central conductors 203*a*, 203*b* which differ from coils 103*a* and 103*b* of FIG. 4*a* by the fact that both extremities of each coil are grounded to the shell structure, the effective length of each coil being λ/2 (or possibly a multiple thereof) so that the ungrounded midpoint of the coil is spaced from each of its grounded extremities by λ/4 (or, possibly, *n*λ/4 where *n* is an odd integer greater than 1). In this instance the reactive coupling between the confronting extremities of the coils is inductive, as indicated at $M_{ab}$ in FIG. 5*b*. Again, the magnitude of the coupling and therefore the tuning of the filter can be varied by sliding or rotating one of the shells relatively to the other within sleeve mounting 6. Naturally, the selected adjustment can again be maintained with the aid of fastening means as mentioned above.

Figure 6:
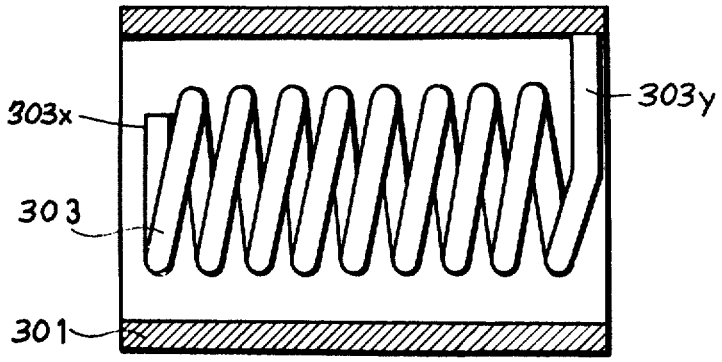
FIG. 6 is an axial sectional view of another modular unit adapted to be used in a system according to our invention.

In FIG. 6 we have shown a modified coil 303 coaxially disposed in an open-ended shell 301, the coil being secured at one extremity 303*y* to the shell which is assumed to be grounded. In contradistinction to the coils shown in FIGS. 1*a*, 3*a* and 4*a*, this coil 303 has its free extremity 303*x* bent back into a radial plane of the shell so that the pitch angle of this extremity is practically zero. As will be apparent from FIG. 7*a*, in which several such coils 303*a* – 303*d* have been shown juxtaposed, the confronting extremities 303*x* of capacitively coupled coil pairs lie parallel to each other for more effective coupling in a position in which these extremities are aligned as shown. Upon a relative rotation of two units so coupled, the capacitance and therefore the resonance frequency of the filter changes more gradually than in the system of FIG. 4*a*, thus enabling a finer tuning.

Figure 7A:
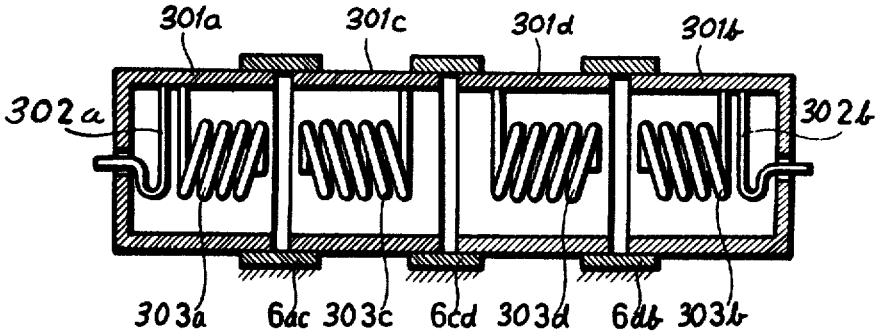
FIG. 7*a* shows a microwave filter composed of four units of the general type shown in FIG. 6.
Figure 7B:
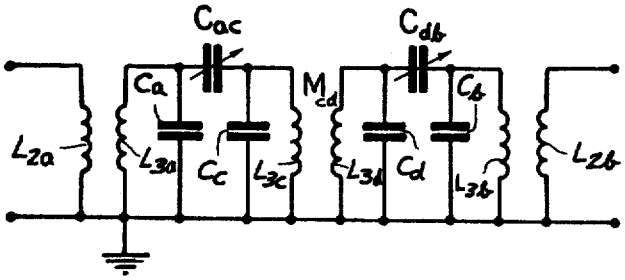
FIG. 7*b* is the equivalent circuit diagram for the filter of FIG. 7*a;*

The modular group shown in FIG. 7*a* comprises a terminal unit with a shell 301*a*, an input loop 302*a* and a coil 303*a*, another terminal unit with a shell 301*b*, an output loop 302*b* and a coil 303*b*, and two intermediate units with shells 301*c*, 301*d* and coils 303*c*, 303*d*. The shells are coaxially mounted, with freedom of relative rotary and possibly axial adjustment, in a set of sleeves 6*ac*, 6*cd* and 6*db* which again may be provided with fastening means for immobilizing same in their selected relative positions. The adjustable coupling capacitances have been shown in FIG. 7*b* at $C_{ac}$ and $C_{db}$; this Figure also depicts the input and output inductances $L_{2a}$, $L_{2b}$, the coil inductances $L_{3a}$ – $L_{3d}$ and the fixed internal capacitances $C_a$ – $C_d$.

Figure 8:
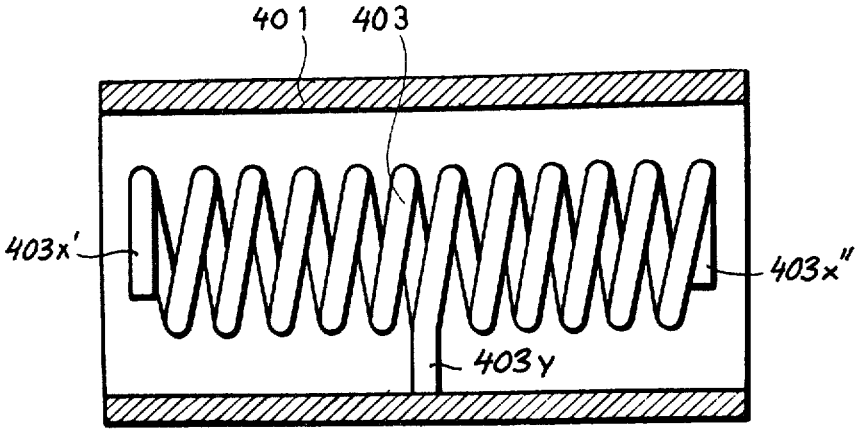
FIG. 8 is an axial sectional view of a unit divided into two generally mirror-symmetrical halves each similar to that of FIG. 6.

In FIG. 8 we have shown a coil 403 which is centrally grounded by a stem 403*y* supporting it on a shell 401 with two open ends, a free extremity 403*x'*, 403*x''* being located close to each of these ends and having the shape of extremity 303*x* in FIG. 6. Each half of coil 403 is thus a substantial duplicate of coil 303 of FIG. 6, the two halves being generally mirror-symmetrical except that the pitch angle of the helix is the same on both sides of the stem 403*y*. A unit such as that shown in FIG. 8 may thus be used in the system of FIG. 7*a*, being interposed between the two terminal units thereof in lieu of intermediate units 301*c*, 303*c* and 301*d*, 303*d*.

Figure 9:
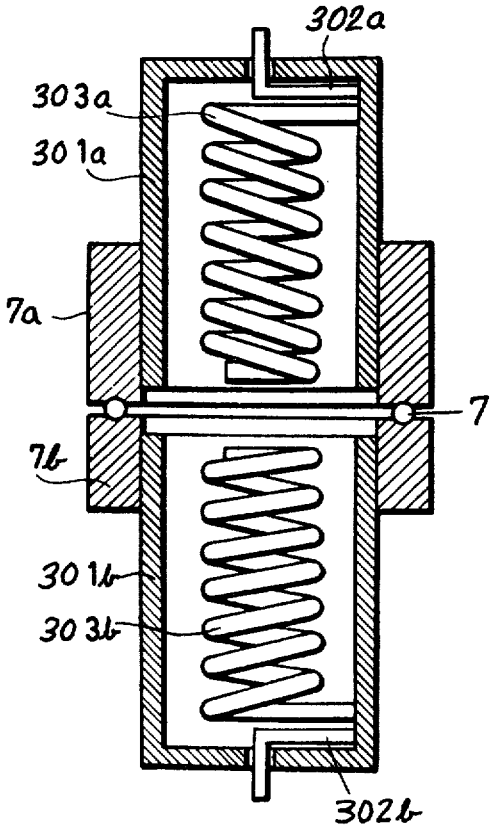
FIG. 9 is a similar view showing an assembly of a pair of units of the type illustrated in FIG. 6.

In FIG. 9 we have illustrated a pair of coaxial units 301*a* – 303*a* and 301*b* – 303*b*, substantially identical with the similarly designated terminal units of FIG. 7*a*, whose mounting comprises a pair of rings 7*a*, 7*b* forming races for a ball of a 7 so as to facilitate relative rotation of the two units. Such a bearing enables not only the selection of desired resonance frequency but also a continuous tuning of the filter between selected frequency limits, e.g. for a periodic shifting or "wobbling" of a test frequency passed by the filter. The parallel extremities 303*x* (FIG. 6) of the coils 303*a*, 303*b*, which may have arc lengths up to about 180°, allow for a substantially linear capacitance change in the course of a half-revolution.

Figure 10:
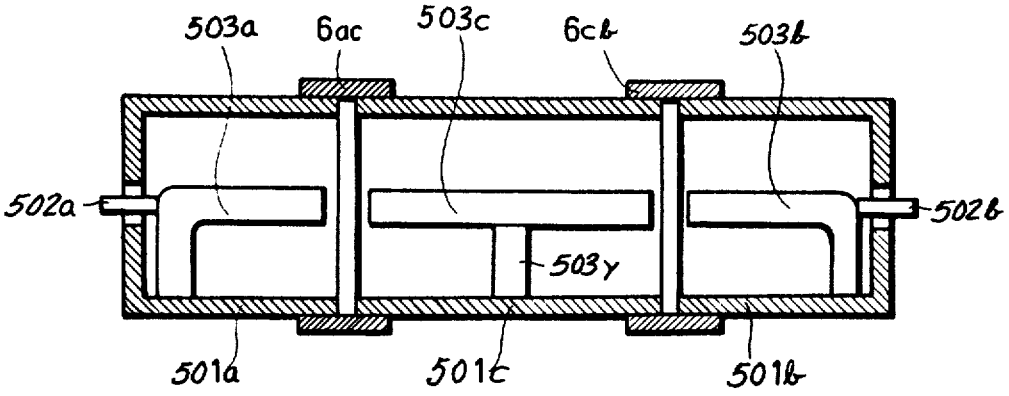
FIG. 10 is an axial sectional view of a three-unit filter according to our invention.

FIG. 10 shows an assembly of three units, i.e. two terminal units with shells 501*a*, 501*b* and an intermediate unit with a shell 501*c*, in which the helical conductors of the preceding embodiments have been replaced by linear conductors 503*a*, 503*b*, 503*c* generally similar to conductor 3' of FIG. 2*a*. The conductor 503*c* of the middle unit is T-shaped, with a central stem 503*y*, in a manner analogous to that of conductor 403 in FIG. 8; its length, accordingly, equals λ/2 or possibly a multiple thereof. The elbow-shaped terminal conductors 503*a*, 503*b* have input and output connections in the form of leads 502*a*, 502*b* galvanically connected thereto at locations spaced from their grounded extremities. Sleeves 6*ac* and 6*cb* again permit a relative displacement of the units for tuning purposes, such displacement being here an axial shift since relative rotation would not alter the capacitance between the central conductors.

Figure 11:
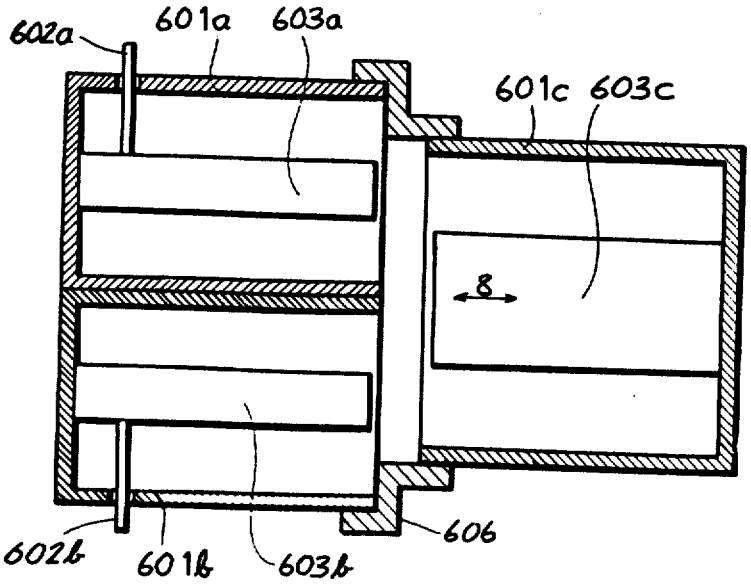
FIG. 11 is a similar view of another three-unit filter according to the invention.

In FIG. 11 we have shown an assembly of two laterally juxtaposed units, with shells 601*a*, 601*b* and linear conductors 603*a*, 603*b*, and an opposite unit with a shell 601*c* and a linear conductor 603*c*, the diameter of shell 601*c* being substantially larger than that of each shell 601*a*, 601*b* and almost as large as the combined diameter of these latter shells. The free end of conductor 603*c*, which also is substantially heavier than each conductor 603*a*, 603*b* confronting it, is capacitively coupled to the free ends of these confronting conductors so as to form a bridge between an input lead 602*a* engaging the conductor 603*a* and an output lead 602*b* engaging the conductor 603*b*. The axis of shell 601*c* is seen to be parallel to and midway between the axes of shells 601*a* and 601*b*. Upon a relative shifting of the two components of this system within a mounting 606, as indicated by an arrow 8, the effective coupling capacitance between the three central conductors can be varied.

We claim:

1. A frequency-selective coupling for high-frequency electromagnetic waves, comprising a cascaded group of juxtaposed but physically separated units antiresonant at a predetermined operating frequency, each unit including a substantially cylindrical grounded conductive shell with at least one open end and a central conductor extending generally axially within said shell, said central conductor having at least one point grounded to said shell and at least one ungrounded point spaced from said grounded point by an odd number of quarter wavlengths at said operating frequency, one of said points being an extremity of said central conductor terminating close to said open end within said shell, the shells of said units confronting one another by their open ends with the corresponding extremities of their central conductors closely spaced from one another in reactively coupled relationship, said shells being provided with tuning means for varying the reactive coupling between said corresponding extremities; input means coupled to the central conductor of one terminal unit; and output means coupled to the central conductor of another terminal unit, said units including a pair of laterally adjoining units of relatively small shell diameter and an opposite unit of relatively large shell diameter, the central conductor of said opposite unit confronting the central conductors of said laterally adjoining units, the axis of said opposite unit being parallel to the axes of said laterally adjoining units and lying substantially midway between the latter.

2. A frequency-selective coupling for high-frequency electromagnetic waves, comprising a cascaded group of coaxially juxtaposed but physically separated units including two terminal units and at least one intermediate unit antiresonant at a predetermined operating frequency, each unit including a substantially cylindrical grounded conductive shell with at least one open end in the case of each terminal unit and two open ends in the case of each intermediate unit and a central conductor extending generally axially within said shell, said central conductor having at least one point grounded to said shell and at least one ungrounded point spaced from said grounded point by an odd number of quarter wavelengths at said operating frequency, one of said points of each terminal unit and two of said points of each intermediate unit being extremities of the central conductors thereof terminating within their shells close to their open ends, the shells of said units confronting one another by their open ends with the corresponding extremities of their central conductors closely spaced from one another in reactively coupled relationship, said shells being provided with tuning means for varying the reactive coupling between said corresponding extremities; input means coupled to the central conductor of one terminal unit; and output means coupled to the central conductor of the other terminal unit.

3. A coupling as defined in claim 2 wherein said tuning means comprises a mounting for holding said shells with freedom of relative movement.

4. A coupling as defined in claim 2 wherein said intermediate unit has a central conductor divided into a pair of generally mirror-symmetrical sections each an odd number of quarter wavelengths long.

5. A frequency-selective coupling for high-frequency electromagnetic waves, comprising a pair of juxtaposed units antiresonant at a predetermined operating frequency and provided with mounting means enabling their relative rotation about a common axis, each unit including a substantially cylindrical grounded conductive shell centered on said axis with at least one open end and a central helical conductor extending generally axially within said shell, said central conductor having at least one point grounded to said shell and an ungrounded extremity spaced from said grounded point by a quarter wavelength at said operating frequency, said extremity terminating close to said open end within said shell, the shells of said units being of like diameters and confronting one another by their open ends with the corresponding extremities of their central conductors closely spaced from one another, said extremities lying in parallel planes transverse to said axes and forming a capacitive coupling variable upon relative rotation of said units.

* * * * *